US011111092B2

(12) United States Patent
Aoki

(10) Patent No.: US 11,111,092 B2
(45) Date of Patent: Sep. 7, 2021

(54) SHEET CONVEYING DEVICE HAVING SHEET SUPPLY TRAY, AND IMAGE RECORDING APPARATUS INCORPORATING THE SHEET CONVEYING DEVICE

(71) Applicant: Brother Kogyo Kabushiki Kaisha, Nagoya (JP)

(72) Inventor: Hirotaka Aoki, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 175 days.

(21) Appl. No.: 16/570,741

(22) Filed: Sep. 13, 2019

(65) Prior Publication Data

US 2020/0002108 A1 Jan. 2, 2020

Related U.S. Application Data

(63) Continuation of application No. PCT/JP2018/012898, filed on Mar. 28, 2018.

(30) Foreign Application Priority Data

Mar. 28, 2017 (JP) ..... JP2017-063985

(51) Int. Cl.
*B65H 3/06* (2006.01)
*B41J 29/13* (2006.01)

(52) U.S. Cl.
CPC ..... *B65H 3/0661* (2013.01); *B41J 29/13* (2013.01); *B65H 3/0684* (2013.01);
(Continued)

(58) Field of Classification Search
CPC ..... B65H 3/0661; B65H 3/0684; B65H 2407/51; B65H 2407/32; B65H 2402/441; B65H 2405/324; B41J 29/13
See application file for complete search history.

(56) References Cited

U.S. PATENT DOCUMENTS 6,308,947 B1 * 10/2001 Kojima ..... B65H 3/0661 271/124
7,131,644 B2 * 11/2006 Williamson ..... B65H 31/34 271/121

(Continued)

FOREIGN PATENT DOCUMENTS

JP 2005-086640 A 3/2005
JP 2014-209710 A 11/2014

OTHER PUBLICATIONS

Oct. 1, 2019—(WO) IPRP—App PCT/JP2018/012898.
Jul. 9, 2018—International Search Report & Written Opinion—Intl App PCT/JP2018/012898.

*Primary Examiner* — Jeremy R Severson
(74) *Attorney, Agent, or Firm* — Banner & Witcoff, Ltd.

(57) ABSTRACT

A sheet conveying device includes: a tray; a roller; a roller arm; a lever; and a dust proof cover including: a first cover, a second cover, and a pressure piece. The roller arm is movable between an abutment position where the roller abuts on the tray and a separation position where the roller is away from the tray. The second cover is movable between a first position in proximity to the tray and a second position away from the tray. The pressure piece is away from the lever to permit the roller to be positioned in the abutment position when the second cover is in the first position, and presses the lever to move the roller to the separation position when the second cover is in the second position.

6 Claims, 6 Drawing Sheets

(52) U.S. Cl.
CPC .. *B65H 2401/222* (2013.01); *B65H 2402/441* (2013.01); *B65H 2405/324* (2013.01); *B65H 2407/32* (2013.01); *B65H 2407/51* (2013.01); *B65H 2601/322* (2013.01); *B65H 2801/12* (2013.01)

(56) References Cited

U.S. PATENT DOCUMENTS

| | | | | |
|---|---|---|---|---|
| 10,233,040 | B2 * | 3/2019 | Ozeki | B65H 3/0653 |
| 2005/0140083 | A1 * | 6/2005 | Koga | B65H 3/00 271/121 |
| 2009/0047038 | A1 | 2/2009 | Kobayashi | |
| 2014/0291917 | A1 | 10/2014 | Uchino | |
| 2016/0332828 | A1 | 11/2016 | Wakakusa et al. | |

* cited by examiner

SHEET CONVEYING DEVICE HAVING SHEET SUPPLY TRAY, AND IMAGE RECORDING APPARATUS INCORPORATING THE SHEET CONVEYING DEVICE

CROSS REFERENCE TO RELATED APPLICATION

This is a bypass continuation application of International Application No. PCT/JP2018/012898 filed Mar. 28, 2018 in the Japan Patent Office acting as Receiving Office, claiming priority from Japanese Patent Application No. 2017-063985 filed Mar. 28, 2017. The entire contents of the International Application and the priority application are incorporated herein by reference.

TECHNICAL FIELD

The present disclosure relates to a sheet conveying device including a sheet supply tray provided at a housing and configured to support one or a plurality of sheets, and an image recording apparatus provided with the sheet conveying device.

BACKGROUND

There is conventionally known an image recording apparatus provided with a housing, a sheet supply tray, and an image recording portion. The sheet supply tray is provided on a rear surface of the housing and configured to support one or a plurality of sheets. The image recording portion is provided in the housing. In this image recording apparatus, a sheet supported by the sheet supply tray is conveyed to the image recording portion, and an image is recorded onto the sheet conveyed to the image recording portion (see Japanese Patent Application Publication No. 2014-209710).

Further, there is also known an image recording apparatus provided with a sheet supply tray configured to support one or a plurality of sheets and a dust proof cover configured to cover a sheet supporting surface of the sheet supply tray (see Japanese Patent Application Publication No. 2005-86640). The dust proof cover serves to prevent a foreign object such as dust from entering into a housing through an opening formed therein at a portion where the sheet supply tray is provided.

The image recording apparatus described in Japanese Patent Application Publication No. 2014-209710 further includes a feed roller configured to feed the sheet supported by the sheet supply tray into the housing. The feed roller is attached to an end portion of a feed-roller arm that is pivotally movable about a pivot shaft. As the feed-roller arm pivotally moves about the pivot shaft, the feed roller is movable between an abutment position and a separation position. In the abutment position, the feed roller is in abutment with the sheet supporting surface of the sheet supply tray. In the separation position, the feed roller is spaced apart from the sheet supporting surface. The feed-roller arm is urged in a direction that causes the feed roller to abut on the sheet supporting surface of the sheet supply tray. The feed-roller arm is provided with a lever for moving the feed roller in the abutment position into the separation position.

SUMMARY

In the image recording apparatus described in Japanese Patent Application Publication No. 2014-209710, when a sheet is inserted into a gap between the feed roller and the sheet supporting surface to be set on the sheet supply tray, the sheet may be folded or bent if the feed roller is in abutment with the sheet supporting surface. Such folding or bending of a sheet is likely to occur in particular when a small number of sheets, such as one or two sheets, are to be set on the sheet supply tray.

Therefore, when setting a sheet onto the sheet supply tray, a user needs to manipulate the lever on the feed-roller arm to move the feed roller into the separation position, and to insert the sheet between the feed roller and the sheet supporting surface while the feed roller is in the separation position. This makes an operation of setting a sheet onto the sheet supply tray cumbersome.

In addition, in an image recording apparatus including a dust proof cover provided over a sheet supply tray, as in the image recording apparatus described in Japanese Patent Application Publication No. 2005-86640, the dust proof cover blocks the user's view, making the lever on the feed-roller arm less visible. This leads to low usability in setting a sheet onto the sheet supply tray.

In view of the foregoing, it is an object of the disclosure to provide a sheet conveying device including a dust proof cover provided at a sheet supply tray, and an image recording apparatus including the sheet conveying device, the sheet conveying device and the image recording apparatus capable of achieving improved usability in setting a sheet onto the sheet supply tray.

In order to attain above and other object, according to one aspect, the disclosure provides a sheet conveying device including: a housing; a sheet supply tray; a feed roller; a roller arm; a lever; and a dust proof cover. The sheet supply tray is supported to the housing and pivotally movable about a first pivot axis between a closed position in proximity to the housing and an open position away from the housing. The sheet supply tray has a sheet supporting surface on which a sheet to be conveyed is supported. The feed roller is configured to feed the sheet supported on the sheet supply tray into the housing. The roller arm supports the feed roller. The roller arm is supported to the housing and pivotally movable about a second pivot axis parallel to the first pivot axis between an abutment position where the feed roller is in abutment with the sheet supply tray and a separation position where the feed roller is positioned spaced apart from the sheet supply tray. The lever is provided at the roller arm and pivotally movable about the second pivot axis together with the roller arm. The dust proof cover is configured to cover a portion of the sheet supporting surface. The dust proof cover includes: a first cover, a second cover, and a pressure piece. The first cover is supported to the housing and pivotally movable about a third pivot axis parallel to the first pivot axis. The second cover is supported to the first cover and pivotally movable about a fourth pivot axis parallel to the third pivot axis between a first position in proximity to the sheet supply tray and a second position away from the sheet supply tray. The pressure piece is provided at the second cover and pivotally movable about the fourth pivot axis together with the second cover. The pressure piece is away from the lever to permit the feed roller to be positioned in the abutment position in a state where the second cover is in the first position. The pressure piece presses the lever to move the feed roller to the separation position in a state where the second cover is in the second position.

According to another aspect, the disclosure provides an image recording apparatus including: a sheet conveying device; and an image recording portion. The image recording portion is configured to record an image on the sheet conveyed by the sheet conveying device. The sheet conveying device includes: a housing; a sheet supply tray; a feed roller; a roller arm; a lever; and a dust proof cover. The sheet supply tray is supported to the housing and pivotally movable about a first pivot axis between a closed position in proximity to the housing and an open position away from the housing. The sheet supply tray has a sheet supporting surface on which a sheet to be conveyed is supported. The feed roller is configured to feed the sheet supported on the sheet supply tray into the housing. The roller arm supports the feed roller. The roller arm is supported to the housing and pivotally movable about a second pivot axis parallel to the first pivot axis between an abutment position where the feed roller is in abutment with the sheet supply tray and a separation position where the feed roller is positioned spaced apart from the sheet supply tray. The lever is provided at the roller arm and pivotally movable about the second pivot axis together with the roller arm. The dust proof cover is configured to cover a portion of the sheet supporting surface. The dust proof cover includes: a first cover, a second cover, and a pressure piece. The first cover is supported to the housing and pivotally movable about a third pivot axis parallel to the first pivot axis. The second cover is supported to the first cover and pivotally movable about a fourth pivot axis parallel to the third pivot axis between a first position in proximity to the sheet supply tray and a second position away from the sheet supply tray. The pressure piece is provided at the second cover and pivotally movable about the fourth pivot axis together with the second cover. The pressure piece is away from the lever to permit the feed roller to be positioned in the abutment position in a state where the second cover is in the first position. The pressure piece presses the lever to move the feed roller to the separation position in a state where the second cover is in the second position.

DETAILED DESCRIPTION

Figure 1:
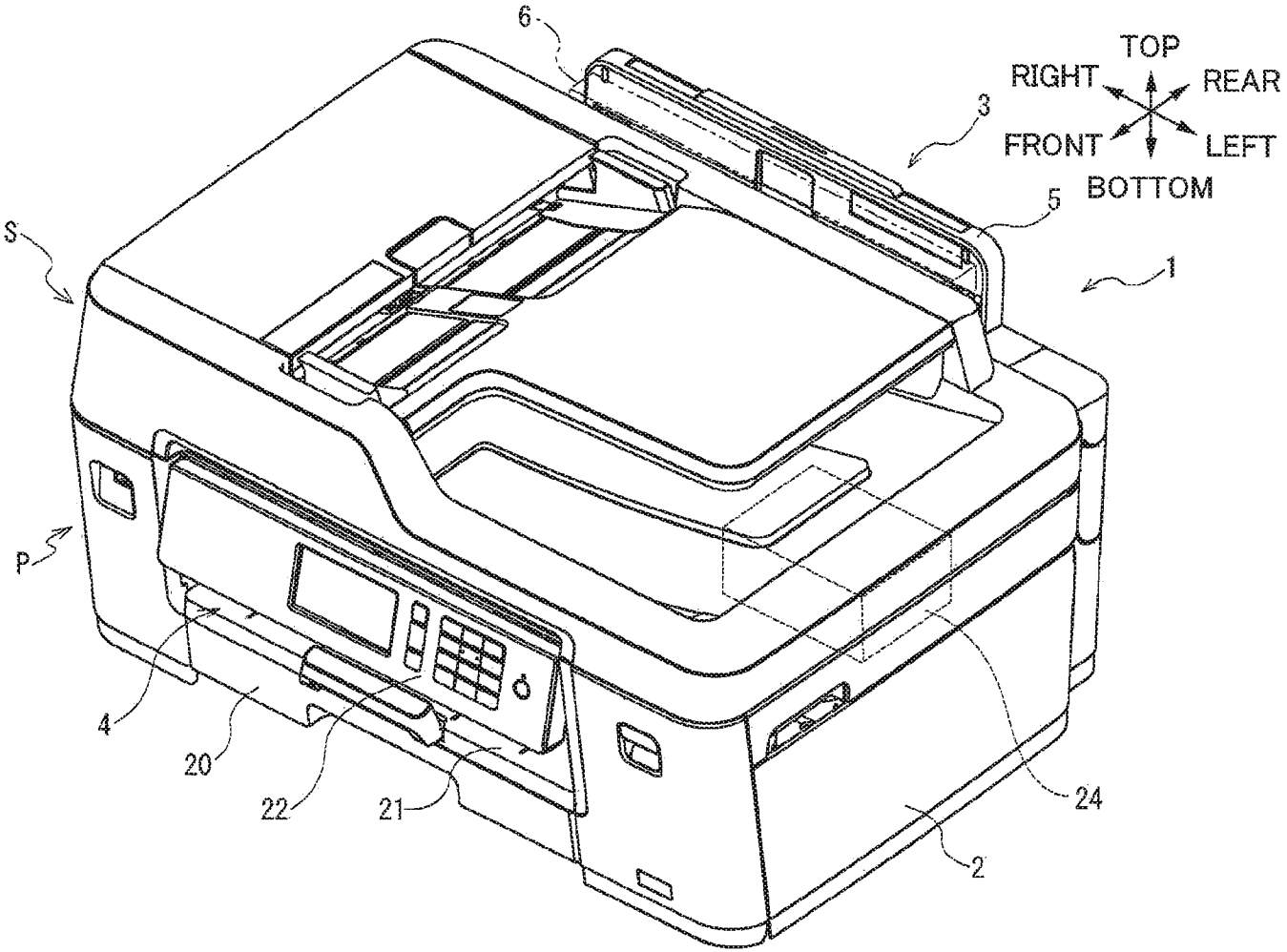
FIG. 1 is a perspective view of a multifunction peripheral provided with a sheet conveying device according to one embodiment.

A multifunction peripheral 1 provided with a sheet conveying device according to one embodiment of the present disclosure will be described with reference to the accompanying drawings, wherein like parts and components are designated by the same reference numerals to avoid duplicating description.

<Overview of Structure of Multifunction Peripheral>

The multifunction peripheral 1 illustrated in FIG. 1 includes a printer section P and a scanner section S. The printer section P is an example of an image recording apparatus. The printer section P and the scanner section S are integrally provided. The printer section P constitutes a lower portion of the multifunction peripheral 1. The scanner section S is disposed above the printer section P. The multifunction peripheral 1 has a printer function, a scanner function, a copy function, and a facsimile function. The printer section P having the printer function is configured as a printer of an inkjet recording type.

In the following descriptions, as illustrated in FIG. 1, a front-rear direction, a left-right direction, and an up-down direction are defined with respect to the multifunction peripheral 1 installed in an operable state.

In the printer section P, an image is recorded on a sheet 18 (see FIG. 2), such as a recording sheet, based on image data inputted from an external device connected to the multifunction peripheral 1 or from a storage medium attached to the multifunction peripheral 1. The external device may be a computer, a digital camera, a USB memory, or the like. The storage medium may be a memory card, for example.

The printer section P includes a housing 2 formed into a substantially rectangular parallelepiped shape. An opening 4 is formed in a front surface of the housing 2 at a center portion thereof in the left-right direction. A front sheet supply tray 20 and a discharge tray 21 are provided in the housing 2 so as to be accessible through the opening 4. The front sheet supply tray 20 is configured to support one or a plurality of sheets 18 substantially horizontally. The discharge tray 21 is formed on an upper surface of the front sheet supply tray 20. An operation panel 22 is provided at the front surface of the housing 2. The operation panel 22 includes a display portion configured to display a status and a function of the multifunction peripheral 1, and an operation portion configured to receive an input operation for the multifunction peripheral 1.

A rear sheet supply tray 5 is provided on a rear surface of the housing 2. The rear sheet supply tray 5 is configured to support one or a plurality of sheets 18. The housing 2 accommodates a recording portion 24 configured to record an image onto the sheet 18 supported by the front sheet supply tray 20 or the rear sheet supply tray 5. The recording portion 24 is an example of an image recording portion.

The printer section P includes a sheet conveying device 3. The sheet conveying device 3 is configured to convey the sheet 18 supported on the rear sheet supply tray 5 toward the recording portion 24.

<Structure of Sheet Conveying Device>

Figure 2:
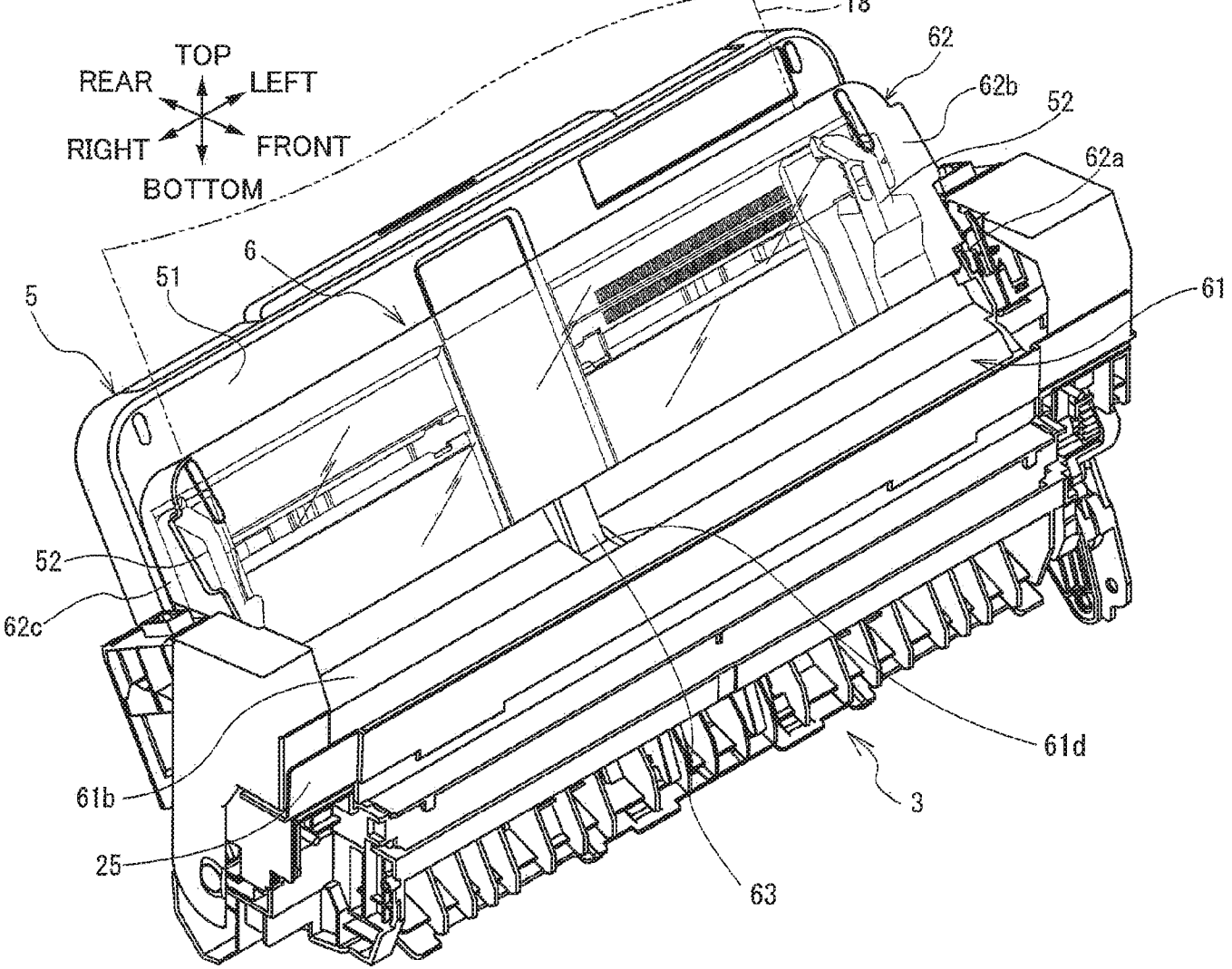
FIG. 2 is a perspective view of a rear sheet supply tray and a dust proof cover of the sheet conveying device according to the embodiment.
Figure 3:
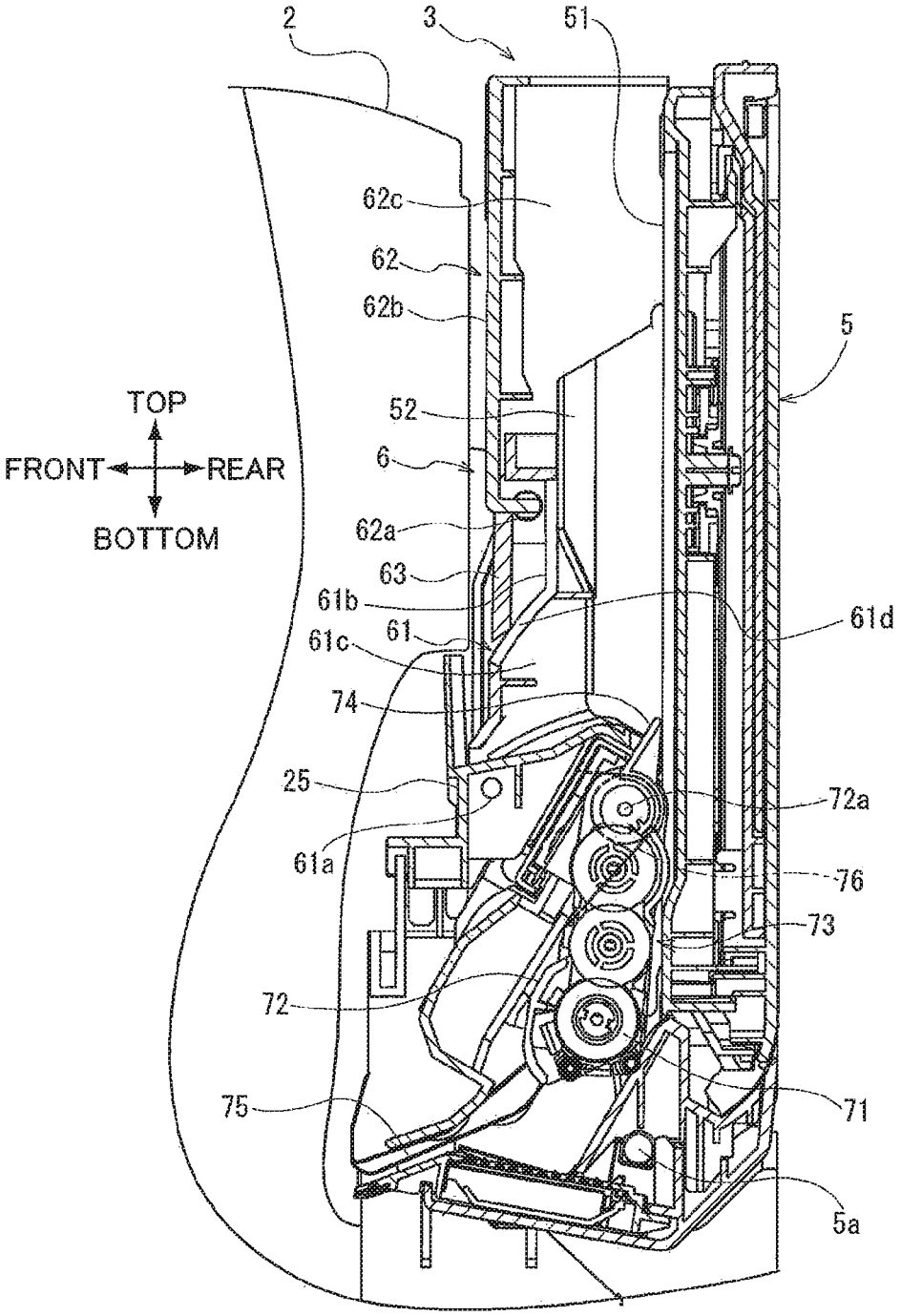
FIG. 3 is a side cross-sectional view of the sheet conveying device according to the embodiment, in which the rear sheet supply tray is in a closed position.
Figure 4:
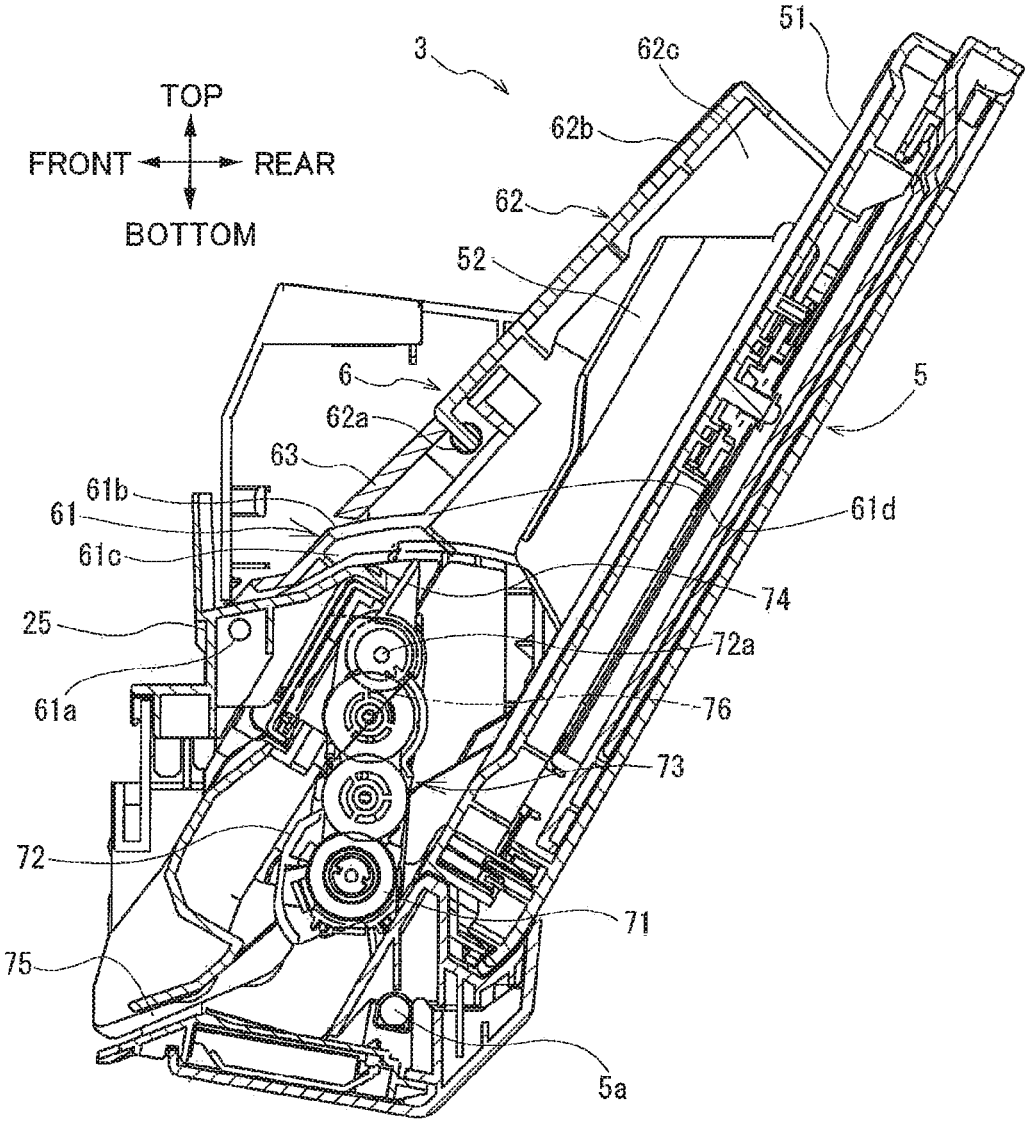
FIG. 4 is a side cross-sectional view of the sheet conveying device according to the embodiment, in which the rear sheet supply tray is in an open position and a second cover of the dust proof cover is in a first position.
Figure 5:
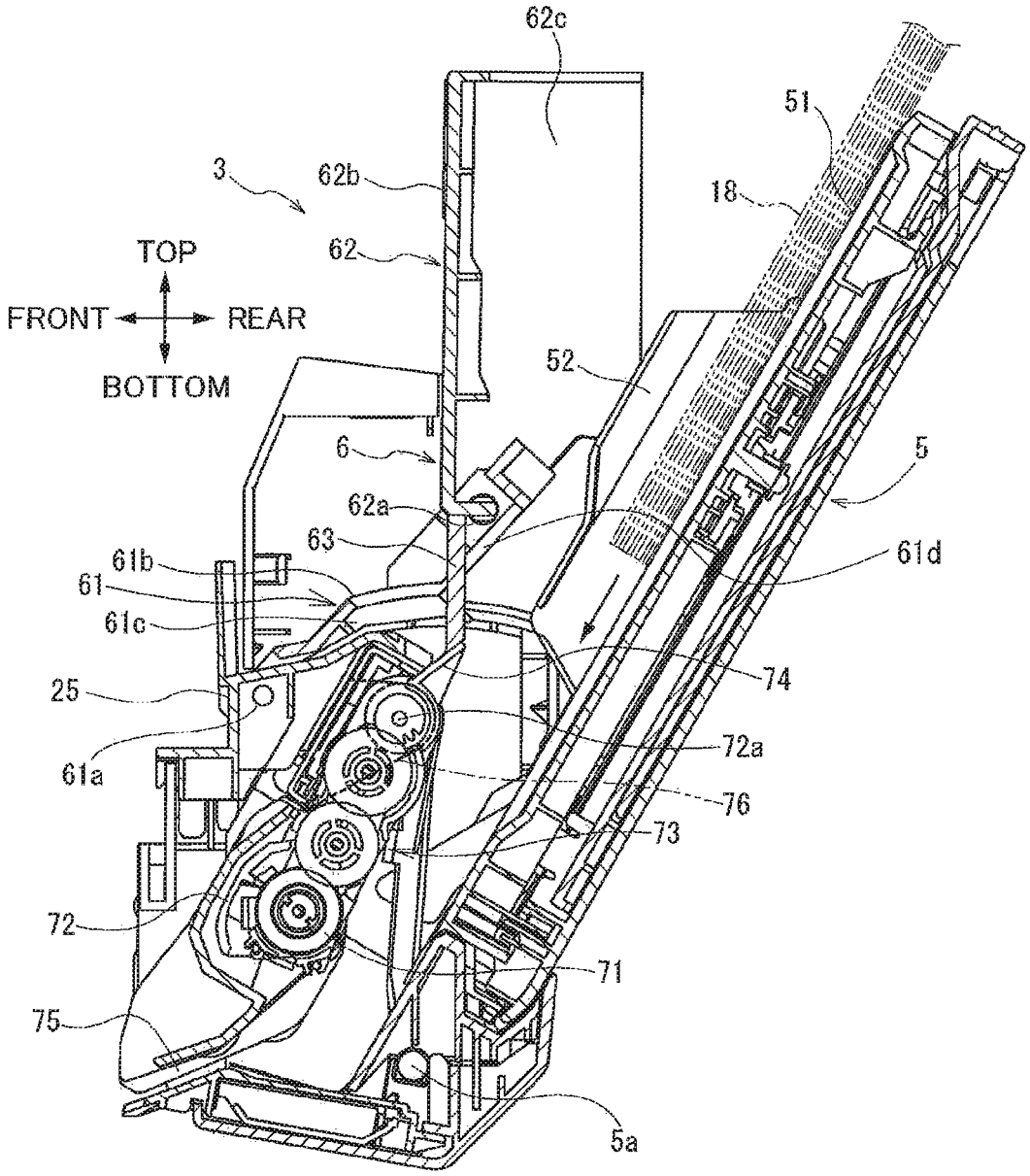
FIG. 5 is a side cross-sectional view of the sheet conveying device according to the embodiment, in which the rear sheet supply tray is in the open position and the second cover is in a second position.

As illustrated in FIGS. 2 through 5, the sheet conveying device 3 includes the housing 2, the rear sheet supply tray 5, a feed roller 71, a feed-roller arm 72, a lever 74, and a dust proof cover 6. The rear sheet supply tray 5 is supported to the housing 2 and pivotally movable about a first pivot shaft 5*a*. The rear sheet supply tray 5 has a sheet supporting surface 51 on which one or a plurality of sheets 18 to be conveyed can be supported. The feed roller 71 is configured to feed the sheet 18 supported on the rear sheet supply tray 5 into the housing 2. Note that the cross-sectional views illustrated in FIGS. 3 through 5 are views taken along a plane perpendicular to the left-right direction and passing through substantially the center of the sheet conveying device 3 in the left-right direction.

The feed-roller arm 72 is configured to rotatably support the feed roller 71. The feed-roller arm 72 is supported to the housing 2 at a substantially center portion of the housing 2 in the left-right direction and pivotally movable about a second pivot shaft 72*a* parallel to the first pivot shaft 5*a*. The lever 74 is provided at the feed-roller arm 72. The dust proof cover 6 is configured to cover at least a portion of the sheet supporting surface 51 of the rear sheet supply tray 5. The rear sheet supply tray 5 is an example of a sheet supply tray. The first pivot shaft 5*a* is an example of a first pivot axis. The feed-roller arm 72 is an example of a roller arm. The second pivot shaft 72*a* is an example of a second pivot axis.

The sheet conveying device 3 is configured to feed the sheets 18 supported on the rear sheet supply tray 5 one by one into the housing 2 with the feed roller 71. Each sheet 18 fed by the feed roller 71 is conveyed into the housing 2 from the rear sheet supply tray 5 through a feed port 75 formed in a lower end portion of the rear sheet supply tray 5.

The rear sheet supply tray 5 is movable between a closed position (i.e., a position illustrated in FIG. 3) and an open position (i.e., a position illustrated in FIG. 4) as the rear sheet supply tray 5 pivotally moves about the first pivot shaft 5*a*. In the closed position, the rear sheet supply tray 5 is in proximity to the housing 2. In the open position, the rear sheet supply tray 5 is away from the housing 2. A surface of the rear sheet supply tray 5 that faces upward when the rear sheet supply tray 5 is in the open position constitutes the sheet supporting surface 51 configured to support the sheets 18.

A pair of side guides 52 is provided on the sheet supporting surface 51. The side guides 52 are movable in the left-right direction and configured to align and regulate a position of the sheet 18 in a widthwise direction. In the sheet conveying device 3, the side guides 52 are moved in the left-right direction in accordance with a widthwise size of the sheet 18 supported by the sheet supporting surface 51, so that a plurality of types of sheet 18 with varied sheet widths can be supported by the sheet supporting surface 51. In the sheet conveying device 3, a direction extending along a surface of the sheet 18 supported on the sheet supporting surface 51 and orthogonal to a conveying direction of the sheet 18 supported on the sheet supporting surface 51 is the left-right direction, and the left-right direction of the sheet 18 is the widthwise direction.

The feed-roller arm 72 is movable between an abutment position (i.e., a position illustrated in FIG. 4) and a separation position (i.e., a position illustrated in FIG. 5) as the feed-roller arm 72 pivotally moves about the second pivot shaft 72*a*. The feed roller 71 is in abutment with the sheet supporting surface 51 of the rear sheet supply tray 5 when the feed-roller arm 72 is in the abutment position. The feed roller 71 is spaced apart from the sheet supporting surface 51 of the rear sheet supply tray 5 when the feed-roller arm 72 is in the separation position. The feed-roller arm 72 is urged by an urging member 76 in a direction that causes the feed roller 71 to abut on the sheet supporting surface 51. The urging member 76 is configured of a torsion spring connected to the housing 2 and the feed-roller arm 72, for example.

The sheet conveying device 3 further includes a motor (not illustrated) configured to generate a driving force. A gear train 73 is disposed inside the feed-roller arm 72. The gear train 73 serves as a driving force transmission mechanism configured to transmit a driving force from the motor to the feed roller 71. The feed roller 71 is driven with the driving force transmitted from the motor via the gear train 73.

The lever 74 is pivotally movable together with the feed-roller arm 72 about the second pivot shaft 72*a*. The lever 74 protrudes in a direction different from a direction in which the feed-roller arm 72 extends from the second pivot shaft 72*a*. In the present embodiment, the lever 74 protrudes in a direction substantially opposite to the direction in which the feed-roller arm 72 extends. Specifically, the lever 74 is disposed on an upper end of the feed-roller arm 72 at a center portion thereof in the left-right direction and protrudes substantially upward from the upper end of the feed-roller arm 72.

In the sheet conveying device 3, the lever 74 is pressed to be pivotally moved in a clockwise direction in FIG. 4, which causes the feed-roller arm 72 to be pivotally moved in the clockwise direction against an urging force of the urging member 76. As the feed-roller arm 72 pivotally moves in the clockwise direction against the urging force of the urging member 76, the feed-roller arm 72 changes its position from the abutment position to the separation position.

The dust proof cover 6 is configured to cover at least a portion of the sheet supporting surface 51 of the rear sheet supply tray 5 to prevent a foreign object such as dust from entering into the housing 2 through the feed port 75 of the rear sheet supply tray 5. The dust proof cover 6 includes a first cover 61, a second cover 62, and a pressure piece 63.

The first cover 61 is supported to the housing 2 and pivotally movable about a third pivot shaft 61*a* parallel to the first pivot shaft 5*a*. The second cover 62 is supported to the first cover 61 and pivotally movable about a fourth pivot shaft 62*a* parallel to the third pivot shaft 61*a*. The pressure piece 63 is provided at the second cover 62. The third pivot shaft 61*a* is an example of a third pivot axis. The fourth pivot shaft 62*a* is an example of a fourth pivot axis.

The housing 2 includes a cover support portion 25 disposed at a position facing the sheet supporting surface 51 of the rear sheet supply tray 5. The first cover 61 is supported to the cover support portion 25 and pivotally movable about the third pivot shaft 61*a*.

Figure 6:
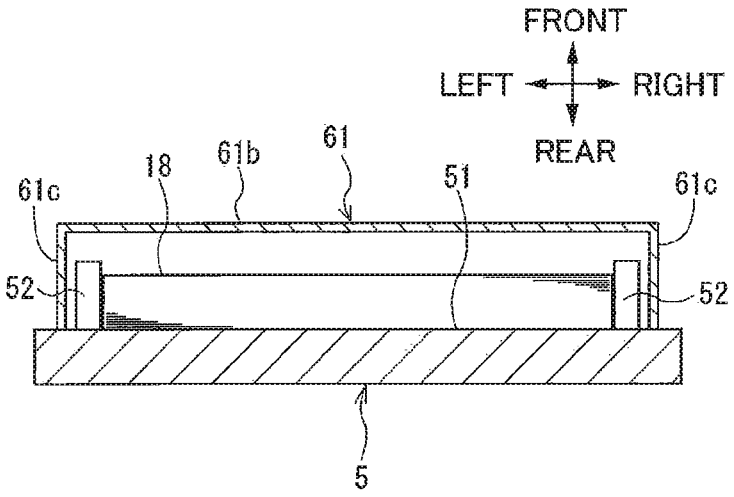
FIG. 6 is a cross-sectional view of the sheet conveying device according to the embodiment as viewed from an upstream side thereof in a conveying direction of a sheet.

As illustrated in FIGS. 2, 3, and 6, the first cover 61 includes a main cover 61*b* and a pair of side covers 61*c*. The main cover 61*b* is disposed at a position facing the sheet supporting surface 51 of the rear sheet supply tray 5. The main cover 61*b* is formed with a slit 61*d* allowing the pressure piece 63 to pass therethrough. The slit 61*d* is positioned at a center portion of the main cover 61*b* in the left-right direction. The side covers 61*c* are disposed at left and right ends of the main cover 61*b*, respectively, and extend from the main cover 61*b* toward the sheet supporting surface 51 of the rear sheet supply tray 5. The main cover 61*b* is an example of a first main cover. The side covers 61*c* are an example of first side covers.

The second cover 62 is movable between a first position (i.e., a position illustrated in FIG. 4) and a second position (i.e., a position illustrated in FIG. 5) as the second cover 62 pivotally moves about the fourth pivot shaft 62*a* while the rear sheet supply tray 5 is in the open position. In the first position, the second cover 62 is in proximity to the rear sheet supply tray 5. In the second position, the second cover 62 is away from the rear sheet supply tray 5. The second cover 62 is disposed at a position facing the side guides 52 on the rear sheet supply tray 5 while the rear sheet supply tray 5 is in the open position. Specifically, the second cover 62 in the first position is disposed at a position covering the side guides 52 in their entirety while the rear sheet supply tray 5 is in the open position.

Similar to the first cover 61, the second cover 62 includes a main cover 62*b* and a pair of side covers 62*c*. The main cover 62*b* is disposed at a position facing the sheet supporting surface 51 of the rear sheet supply tray 5. The side covers 62*c* are disposed at left and right ends of the main cover 62*b*, respectively, and extend from the main cover 62*b* toward the sheet supporting surface 51 of the rear sheet supply tray 5. The main cover 62*b* is disposed at a position spaced apart from the sheet supporting surface 51 in a direction orthogonal to the sheet supporting surface 51. The main cover 62*b* is also disposed at a position covering the side guides 52 in their entirety while the rear sheet supply tray 5 is in the open position and the second cover 62 is in the first position. The main cover 62*b* is an example of a second main cover. The side covers 62*c* are an example of second side covers.

In this way, the first cover 61 includes the side covers 61*c* and the second cover 62 includes the side covers 62*c*. Thus, a foreign object such as dust can be prevented from entering into the housing 2 from the left and right sides of the rear sheet supply tray 5.

The side covers 61*c* of the first cover 61 and the side covers 62*c* of the second cover 62 are disposed at positions outside of the side guides 52 in the left-right direction even when the side guides 52 are so arranged as to provide a maximum distance therebetween in the left-right direction. In other words, the side covers 61*c* and the side covers 62*c* are disposed at positions outside of the side guides 52 in the left-right direction even when the side guides 52 support a sheet 18 with a maximum widthwise size that can be supported by the rear sheet supply tray 5. The side covers 61*c* and the side covers 62*c* are disposed at positions covering the side guides 52 in their entirety as viewed in the left-right direction when the rear sheet supply tray 5 is in the open position and the second cover 62 is in the first position.

Therefore, the rear sheet supply tray 5 can be covered by the dust proof cover 6 even when the rear sheet supply tray 5 is supporting a sheet 18 with a maximum widthwise size that can be supported by the rear sheet supply tray 5. Thus, regardless of the widthwise size of the sheet 18 being supported by the rear sheet supply tray 5, a foreign object such as dust can be prevented from entering into the housing 2.

In addition, the side covers 61*c* of the first cover 61 and the side covers 62*c* of the second cover 62 are disposed at positions inside of left and right edges of the sheet supporting surface 51 of the rear sheet supply tray 5 in the left-right direction. Therefore, no gap is formed between widthwise ends of the rear sheet supply tray 5 and the side covers 61*c* and 62*c* in the left-right direction. This configuration can enhance the effect of preventing a foreign object such as dust from entering into the housing 2.

Furthermore, the side covers 61*c* of the first cover 61 and the side covers 62*c* of the second cover 62 are in abutment with the sheet supporting surface 51 of the rear sheet supply tray 5 both when the rear sheet supply tray 5 is in the closed position and when the rear sheet supply tray 5 is in the open position and the second cover 62 is in the first position. Therefore, no gap is formed between the sheet supporting surface 51 of the rear sheet supply tray 5 and extending ends of the side covers 61*c* and 62*c*. This configuration can further enhance the effect of preventing a foreign object such as dust from entering into the housing 2.

The pressure piece 63 is disposed on a lower end of the main cover 62*b* at a center portion thereof in the left-right direction. The pressure piece 63 extends from the lower end of the main cover 62*b* in a direction away from the second cover 62. The pressure piece 63 has one end attached to the main cover 62*b*, and the other end farther from the main cover 62*b* than the one end is from the main cover 62*b*. The other end of the pressure piece 63 has a sloped endface such that its rear end is closer to the main cover 62*b* than its front end is to the main cover 62*b*.

The pressure piece 63 is pivotally movable together with the second cover 62 about the fourth pivot shaft 62*a*. The pressure piece 63 is configured to press the lever 74 to cause the feed-roller arm 72 (more specifically, the feed roller 71) to pivotally move in a clockwise direction in FIG. 5 as the pressure piece 63 pivotally moves together with the second cover 62 when the second cover 62 moves from the first position to the second position. The pressure piece 63 may be integral with the second cover 62. Alternatively, the pressure piece 63 may be a separate member from the second cover 62 as long as the pressure piece 63 can move together with the second cover 62.

In the sheet conveying device 3 configured as described above, a plurality of the sheets 18 supported on the sheet supporting surface 51 of the rear sheet supply tray 5 is fed one by one by the feed roller 71 into the housing 2 through the feed port 75. Each sheet 18 fed into the housing 2 is conveyed to the recording portion 24. An image is recorded on the sheet 18 by the recording portion 24.

In the sheet conveying device 3, when the sheets 18 are set onto the sheet supporting surface 51 of the rear sheet supply tray 5, the second cover 62 can be moved to the second position to increase a gap between the sheet supporting surface 51 and the second cover 62 at an upper portion of the rear sheet supply tray 5. Hence, the sheets 18 are easily to be set from an upper side of the rear sheet supply tray 5.

Furthermore, the pressure piece 63 is configured to be pivotally movable together with the second cover 62 about the fourth pivot shaft 62*a* to press the lever 74 when the second cover 62 is moved from the first position to the second position. Specifically, when the second cover 62 pivotally moves from the first position to the second position, the pressure piece 63 is moved in conjunction with the pivotal movement of the second cover 62. At this time, the pressure piece 63 passes through the slit 61*d* formed in the main cover 61*b* to press the lever 74 by the sloped surface of the pressure piece 63. Upon the lever 74 being pressed by the pressure piece 63, the feed-roller arm 72 pivotally moves in the clockwise direction in FIG. 5, and the feed roller 71 moves from the abutment position to the separation position.

In other words, when the second cover 62 is in the first position (FIG. 4), the pressure piece 63 refrains from pressing the lever 74, and the feed roller 71 is in the abutment position. That is, when the second cover 62 is in the first position, the pressure piece 63 is away from the lever 74 to permit the feed roller 71 to be positioned in the abutment position. On the other hand, when the second cover 62 is in the second position, the pressure piece 63 presses the lever 74 to cause the feed roller 71 to move to the separation position.

In this way, when the second cover 62 is moved from the first position to the second position, the pressure piece 63 presses the lever 74 to cause the feed roller 71 to move from the abutment position to the separation position. Thus, a gap is formed between the sheet supporting surface 51 of the rear sheet supply tray 5 and the feed roller 71. Therefore, a user can insert the sheets 18 into the gap between the sheet supporting surface 51 and the feed roller 71 without manipulating the lever 74. Thus, usability in setting the sheet 18 onto the rear sheet supply tray 5 can be improved.

In addition, in the dust proof cover 6 according to the present embodiment, the second cover 62 is formed of a transparent material as illustrated in FIG. 2. The second cover 62 is disposed at a position facing the side guides 52 while the rear sheet supply tray 5 is in the open position. Therefore, as the second cover 62 is formed of a transparent material, the user can visually recognize the side guides 52 through the second cover 62 when setting the sheets 18 onto the rear sheet supply tray 5. This configuration can improve usability, for example, in adjusting an interval between the side guides 52 to an interval suitable for a size of the sheets 18 to be set.

Incidentally, in the dust proof cover 6, not only the second cover 62 but also the first cover 61 may be formed of a transparent material. In other words, in the dust proof cover 6, of the first cover 61 and the second cover 62, at least the second cover 62 is formed of a transparent material.

<Operational Advantages>

In the present embodiment, the multifunction peripheral 1 includes the sheet conveying device 3 configured as follows.

The sheet conveying device 3 includes the housing 2, the rear sheet supply tray 5, the feed roller 71, the feed-roller arm 72, the lever 74, and the dust proof cover 6 including the first cover 61, the second cover 62, and the pressure piece 63. When the second cover 62 is in the first position, the pressure piece 63 is away from the lever 74 to permit the feed roller 71 to be positioned in the abutment position. When the second cover 62 is in the second position, the pressure piece 63 presses the lever 74 to cause the feed roller 71 to move to the separation position.

This configuration allows the user to insert the sheets 18 into the gap between the sheet supporting surface 51 and the feed roller 71 without manipulating the lever 74. Thus, usability in setting the sheets 18 onto the rear sheet supply tray 5 can be improved.

The first cover 61 includes the main cover 61*b* and the side covers 61*c*. The main cover 61*b* is disposed at a position facing the sheet supporting surface 51 of the rear sheet supply tray 5. The side covers 61*c* are provided on the respective side end portions of the main cover 61*b*, and extend from the main cover 61*b* toward the rear sheet supply tray 5. Further, the second cover 62 includes the main cover 62*b* and the side covers 62*c*. The main cover 62*b* is disposed at a position facing the sheet supporting surface 51 of the rear sheet supply tray 5. The side covers 62*c* are provided on the respective side end portions of the main cover 62*b*, and extend from the main cover 62*b* toward the rear sheet supply tray 5.

Thus, a foreign object such as dust can be prevented from entering into the housing 2 through the sides of the rear sheet supply tray 5.

The rear sheet supply tray 5 includes the pair of side guides 52. The side guides 52 are movable in the widthwise direction that is the direction orthogonal to the conveying direction of the sheet 18. The side guides 52 are configured to regulate the widthwise position of the sheet 18 supported on the rear sheet supply tray 5. The side covers 61*c* and 62*c* are positioned outside of the side guides 52 in the widthwise direction even when the side guides 52 are arranged so as to provide a maximum distance therebetween in the widthwise direction.

Thus, regardless of the widthwise size of the sheet 18 being supported by the rear sheet supply tray 5, a foreign object such as dust can be prevented from entering into the housing 2.

The side covers 61*c* and 62*c* are positioned inside of the widthwise ends of the sheet supporting surface 51 of the rear sheet supply tray 5 in the widthwise direction.

Therefore, no gap is formed between the widthwise ends of the rear sheet supply tray 5 and the side covers 61*c* and 62*c* in the widthwise direction. This configuration can enhance the effect of preventing a foreign object such as dust from entering into the housing 2.

Of the first cover 61 and the second cover 62, at least the second cover 62 is formed of a transparent material.

This configuration can improve usability, for example, in adjusting the interval between the side guides 52 to an interval suitable for the size of the sheet 18 to be set.

While the description has been made in detail with reference to the embodiments thereof, it would be apparent to those skilled in the art that various changes and modifications may be made therein without departing from the scope of the above-described embodiments.

The present disclosure exemplified in the embodiments, modification and examples described above may be summarized as follows.

(1) According to one aspect, the disclosure provides a sheet conveying device including: a housing; a sheet supply tray; a feed roller; a roller arm; a lever; and a dust proof cover. The sheet supply tray is supported to the housing and pivotally movable about a first pivot axis between a closed position in proximity to the housing and an open position away from the housing. The sheet supply tray has a sheet supporting surface on which a sheet to be conveyed is supported. The feed roller is configured to feed the sheet supported on the sheet supply tray into the housing. The roller arm supports the feed roller. The roller arm is supported to the housing and pivotally movable about a second pivot axis parallel to the first pivot axis between an abutment position where the feed roller is in abutment with the sheet supply tray and a separation position where the feed roller is positioned spaced apart from the sheet supply tray. The lever is provided at the roller arm and pivotally movable about the second pivot axis together with the roller arm. The dust proof cover is configured to cover a portion of the sheet supporting surface. The dust proof cover includes: a first cover, a second cover, and a pressure piece. The first cover is supported to the housing and pivotally movable about a third pivot axis parallel to the first pivot axis. The second cover is supported to the first cover and pivotally movable about a fourth pivot axis parallel to the third pivot axis between a first position in proximity to the sheet supply tray and a second position away from the sheet supply tray. The pressure piece is provided at the second cover and pivotally movable about the fourth pivot axis together with the second cover. The pressure piece is away from the lever to permit the feed roller to be positioned in the abutment position in a state where the second cover is in the first position. The pressure piece presses the lever to move the feed roller to the separation position in a state where the second cover is in the second position.

(2) In the sheet conveying device according to the aspect 1, preferably, the first cover includes: a first main cover disposed at a position facing the sheet supporting surface; and a pair of first side covers each extending from each side end portion of the first main cover toward the sheet supply tray, and the second cover includes: a second main cover disposed at a position facing the sheet supporting surface; and a pair of second side covers each extending from each side end portion of the second main cover toward the sheet supply tray.

(3) In the sheet conveying device according to the aspect 2, preferably, the sheet conveying device further includes a pair of side guides provided at the sheet supply tray and movable in a widthwise direction orthogonal to a conveying direction of the sheet. The pair of side guides is configured to regulate a position of the sheet supported on the sheet supply tray in the widthwise direction. The pair of first side covers and the pair of second side covers are positioned outside of the pair of side guides in the widthwise direction even in a state where the pair of side guides provides a maximum distance therebetween in the widthwise direction.

(4) In the sheet conveying device according to the aspect 2 or 3, preferably, the pair of first side covers and the pair of second side covers are positioned inside of the sheet supporting surface in the widthwise direction.

(5) In the sheet conveying device according to any one of the aspects 1 to 4, preferably, in the dust proof cover, at least the second cover is made of a transparent material.

(6) According to another aspect, the disclosure provides an image recording apparatus including: a sheet conveying device; and an image recording portion. The image recording portion is configured to record an image on the sheet conveyed by the sheet conveying device. The sheet conveying device includes: a housing; a sheet supply tray; a feed roller; a roller arm; a lever; and a dust proof cover. The sheet supply tray is supported to the housing and pivotally movable about a first pivot axis between a closed position in proximity to the housing and an open position away from the housing. The sheet supply tray has a sheet supporting surface on which a sheet to be conveyed is supported. The feed roller is configured to feed the sheet supported on the sheet supply tray into the housing. The roller arm supports the feed roller. The roller arm is supported to the housing and pivotally movable about a second pivot axis parallel to the first pivot axis between an abutment position where the feed roller is in abutment with the sheet supply tray and a separation position where the feed roller is positioned spaced apart from the sheet supply tray. The lever is provided at the roller arm and pivotally movable about the second pivot axis together with the roller arm. The dust proof cover is configured to cover a portion of the sheet supporting surface. The dust proof cover includes: a first cover, a second cover, and a pressure piece. The first cover is supported to the housing and pivotally movable about a third pivot axis parallel to the first pivot axis. The second cover is supported to the first cover and pivotally movable about a fourth pivot axis parallel to the third pivot axis between a first position in proximity to the sheet supply tray and a second position away from the sheet supply tray. The pressure piece is provided at the second cover and pivotally movable about the fourth pivot axis together with the second cover. The pressure piece is away from the lever to permit the feed roller to be positioned in the abutment position in a state where the second cover is in the first position. The pressure piece presses the lever to move the feed roller to the separation position in a state where the second cover is in the second position.

According to the present disclosure, usability in setting a sheet onto a sheet supply tray can be improved.

What is claimed is:

1. A sheet conveying device comprising:

a housing;

a sheet supply tray supported to the housing and pivotally movable about a first pivot axis between a closed position in proximity to the housing and an open position away from the housing, the sheet supply tray having a sheet supporting surface on which a sheet to be conveyed is supported;

a feed roller configured to feed the sheet supported on the sheet supply tray into the housing;

a roller arm supporting the feed roller, the roller arm being supported to the housing and pivotally movable about a second pivot axis parallel to the first pivot axis between an abutment position where the feed roller is in abutment with the sheet supply tray and a separation position where the feed roller is positioned spaced apart from the sheet supply tray;

a lever provided at the roller arm and pivotally movable about the second pivot axis together with the roller arm; and a dust proof cover configured to cover a portion of the sheet supporting surface, the dust proof cover comprising:

a first cover supported to the housing and pivotally movable about a third pivot axis parallel to the first pivot axis;

a second cover supported to the first cover and pivotally movable about a fourth pivot axis parallel to the third pivot axis between a first position in proximity to the sheet supply tray and a second position away from the sheet supply tray; and a pressure piece provided at the second cover and pivotally movable about the fourth pivot axis together with the second cover, the pressure piece being away from the lever to permit the feed roller to be positioned in the abutment position in a state where the second cover is in the first position, and the pressure piece pressing the lever to move the feed roller to the separation position in a state where the second cover is in the second position.

2. The sheet conveying device according to claim 1, wherein the first cover comprises:

a first main cover disposed at a position facing the sheet supporting surface; and a pair of first side covers each extending from each side end portion of the first main cover toward the sheet supply tray, wherein the second cover comprises:

a second main cover disposed at a position facing the sheet supporting surface; and a pair of second side covers each extending from each side end portion of the second main cover toward the sheet supply tray.

3. The sheet conveying device according to claim 2, further comprising a pair of side guides provided at the sheet supply tray and movable in a widthwise direction orthogonal to a conveying direction of the sheet, the pair of side guides being configured to regulate a position of the sheet supported on the sheet supply tray in the widthwise direction, wherein the pair of first side covers and the pair of second side covers are positioned outside of the pair of side guides in the widthwise direction even in a state where the pair of side guides provides a maximum distance therebetween in the widthwise direction.

4. The sheet conveying device according to claim 2, wherein the pair of first side covers and the pair of second side covers are positioned inside of the sheet supporting surface in the widthwise direction.

5. The sheet conveying device according to claim 1, wherein, in the dust proof cover, at least the second cover is made of a transparent material.

6. An image recording apparatus comprising:

a sheet conveying device; and an image recording portion configured to record an image on the sheet conveyed by the sheet conveying device, the sheet conveying device comprising:

a housing;

a sheet supply tray supported to the housing and pivotally movable about a first pivot axis between a closed position in proximity to the housing and an open position away from the housing, the sheet supply tray having a sheet supporting surface on which a sheet to be conveyed is supported;

a feed roller configured to feed the sheet supported on the sheet supply tray into the housing;

a roller arm supporting the feed roller, the roller arm being supported to the housing and pivotally movable about a second pivot axis parallel to the first pivot axis between an abutment position where the feed roller is in abutment with the sheet supply tray and a separation position where the feed roller is positioned spaced apart from the sheet supply tray;

a lever provided at the roller arm and pivotally movable about the second pivot axis together with the roller arm; and a dust proof cover configured to cover a portion of the sheet supporting surface, the dust proof cover comprising:

a first cover supported to the housing and pivotally movable about a third pivot axis parallel to the first pivot axis;

a second cover supported to the first cover and pivotally movable about a fourth pivot axis parallel to the third pivot axis between a first position in proximity to the sheet supply tray and a second position away from the sheet supply tray; and a pressure piece provided at the second cover and pivotally movable about the fourth pivot axis together with the second cover, the pressure piece being away from the lever to permit the feed roller to be positioned in the abutment position in a state where the second cover is in the first position, and the pressure piece pressing the lever to move the feed roller to the separation position in a state where the second cover is in the second position.

* * * * *